United States Patent [19]

Fitzner et al.

[11] 4,106,275

[45] Aug. 15, 1978

[54] PROCESS AND DEVICE FOR HIGH SPEED THREADING OF YARN INTO A FALSE-TWISTING SPINDLE

[75] Inventors: Josef Fitzner, Erlenbach; Lothar Löw, Elsenfeld, both of Fed. Rep. of Germany

[73] Assignee: Akzona Incorporated, Asheville, N.C.

[21] Appl. No.: 816,565

[22] Filed: Jul. 18, 1977

[30] Foreign Application Priority Data

Jul. 31, 1976 [DE] Fed. Rep. of Germany ..... 2634492

[51] Int. Cl.[2] ..... D01H 13/04; D02G 1/04

[52] U.S. Cl. ..... 57/77.33; 57/106; 57/156

[58] Field of Search ..... 57/34 R, 77.3, 77.33, 57/106, 51.5, 156

[56] References Cited

U.S. PATENT DOCUMENTS

| | | | |
|---|---|---|---|
| 3,363,409 | 1/1968 | Schwabe et al. | 57/77.33 X |
| 3,482,387 | 12/1969 | Slack | 57/106 |
| 3,574,273 | 4/1971 | Hilbert | 57/77.33 X |
| 3,826,073 | 7/1974 | Hoeber et al. | 57/77.33 |
| 3,875,735 | 4/1975 | Benyon | 57/77.33 |

FOREIGN PATENT DOCUMENTS

| | | | |
|---|---|---|---|
| 1,209,732 | 3/1968 | United Kingdom | 57/77.33 |

*Primary Examiner*—Donald Watkins
*Attorney, Agent, or Firm*—Francis W. Young; Tom R. Vestal

[57] ABSTRACT

The invention relates to a process for the high speed threading of yarn into a false-twisting spindle, whereby the twisting pin is set in a "rotor" body located between an upstream and a downstream pipe and passes through a threading aperture in perpendicular alignment with said pin, as well as a device to carry out the process.

2 Claims, 6 Drawing Figures

PROCESS AND DEVICE FOR HIGH SPEED THREADING OF YARN INTO A FALSE-TWISTING SPINDLE

False-twisting spindles, also referred to as false-twisting pipes, are commonly equipped with a diabolo-shaped twisting pin on which the yarn to be false-twisted is wound. A definite relationship is thus created between spindle speed and number of turns applied to the yarn. Whereas in the past the twisting pin was located in the spindle head (c.f. Textilindustry 1965, Vol. 7, page 526, FIG. 25*a* and German Patent Disclosure No. 1 435 522, FIG. 1) more recently, high speed false-twisting spindles were preferred whereby the twisting pin was located approximately equidistantly between the feed and delivery points of the yarn in a "rotor" body aligned between an upstream and downstream pipe limiting the balloon, said pin passing perpendicularly into a cylindrical threading aperture (c.f. Textilindustry 1965, Vol 7, page 526 25*c* and German Patent Disclosure No. 1 435 522, FIGS. 2, 3, and 4). The cylindrical threading aperture may have any optional, (e.g. circular, elliptical, or oblong) cross section.

Threading the yarn into the false-twisting spindle is complicated even for spindles with twisting pins in the head location, because the yarn, depending on whether it has a S or Z false-twist, must be fed in from a certain side between twisting pin and twisting pipe and then fed back from the opposite side and transported in the first direction, so that the yarn assumes, as it should, an angle of contact of about 360° on the twisting pin. While auxiliary systems such as needles of a special design, as well as special threading techniques may facilitate threading (c.f. German Patent Disclosure No. 2 022 706), they do not change the fact that threading of the false-twisting spindle is a time-consuming procedure. It has therefore been suggested to have the false-twisting spindle threaded externally with a length of yarn to which during operation the yarn to be false-twisted is tied and pulled through the twisitng pipe. While this has moved the time-consuming activity of threading away from the work location, it has not eliminated it.

Even more difficult is the threading of false-twisting spindles with centrally located twisting pins, which are only accessible by a cylindrical threading aperture and via the yarn guiding channels formed by pipes located upstream and downstream. These false-twisting spindles require, even with mechanical aids, great skill on the part of the operators as well as considerable time for threading up.

The objective of this invention is to provide a process as well as a device for the high-speed threading of yarn into a false-twisting spindle with centrally located twisting pin, whereby the yarn is placed reliably and largely automatically around the diabolo with few hand motions. This objective is met with the process of the above described type in that the threading aperture is temporarily locked under formation of a yarn duct connecting the yarn guiding duct of the upstream pipe with the yarn guiding duct of the downstream pipe, which yarn duct winds helically on the twisting pin, whereby the yarn by application of a vacuum at the delivery end of the downstream pipe is aspirated through the yarn guiding duct of the upstream pipe, through the yarn duct surrounding the twisting pipe and through the yarn guiding duct of the downstream pipe.

According to the process of the invention an external series of false-twisting spindles prethreaded with yarn lengths are quite easily prepared, and can then be used without much loss of time in the plant.

Because of the simplicity of the process and of the means required to carry it out, the process according to the invention can also be used directly on false-twisting texturing machines, if at the beginning of the pirn doff or if in case of yarn breakage, rethreading of a false-twisting pipe becomes necessary.

In the latter case the yarn is aspirated preferably by means of a mobile suction device located at the delivery end of the downstream pipe, for example a commercial suction gun, by means of which the yarn is immediately fed to the next threadguiding organ e.g. to a feed unit.

A preferred version of carrying out the process of the invention is characterized by two "pistons" with machined lugs, whose external shape matches the cylindrical threading aperture of the false-twisting spindle and provided with a yarn duct top part and a yarn duct bottom part as well as clearances for the twisting pins, whereby the "pistons" inserted from the opposite side into the threading aperture form together with the twisting pin a helical yarn duct, connecting the thread guiding duct of the upstream and the downstream pipes and by a suction unit, which can be connected to the delivery end of the downstream pipe. The invention is explained in more detail on hand of enclosed drawings in which the following is a brief description.

DETAILED DESCRIPTION OF THE DRAWINGS

Figure 1:
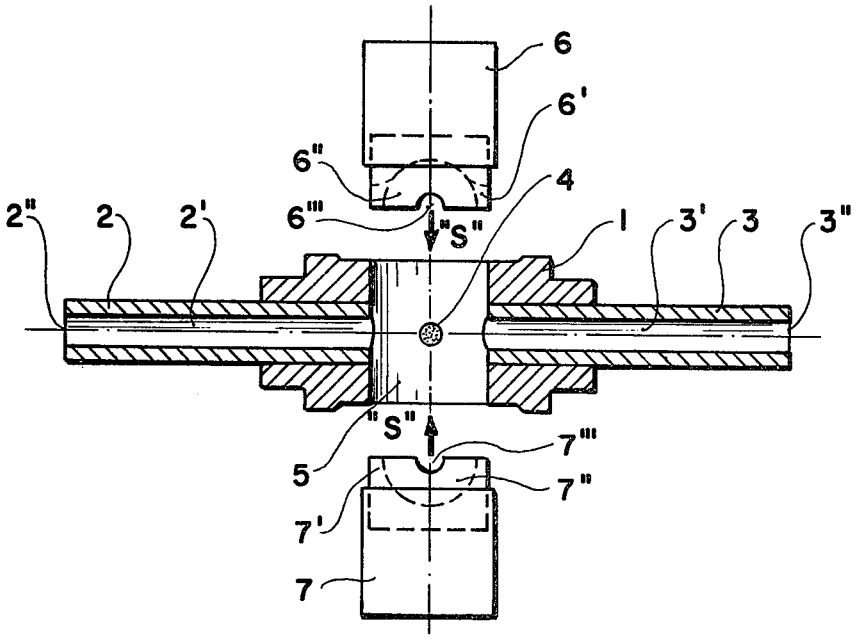
FIGS. 1 to 4 — illustrate the threading procedure according to the invention in four consecutive phases and FIG. 5 — is a cutaway view of the yarn threaded in the false-twisting spindle.

FIG. 1 shows a false-twisting spindle composed essentially of a "rotor" body 1, an upstream pipe 2 with yarn guiding duct 2', a downstream pipe 3 with yarn guiding duct 3' and a twisting pin 4, which passes through a cylindrical threading aperture in perpendicular alignment with it. Also shown are the two "pistons" 6 and 7 which at their end facing the false-twisting spindle are provided with machined lugs 6' and 7', whose external shapes match the shape of cylindrical threading aperture 5, and which are provided with a yarn duct top part 6'' and a yarn duct bottom part 7'' as well as clearance grooves 6''' and 7'''for twisting pin 4. The two "pistons" 6 and 7 are now actuated in direction of arrow S in the threading aperture until the end faces of machined lugs 6' and 7' while surrounding twisting pin 4 make close contact with each other.

Figure 1A:
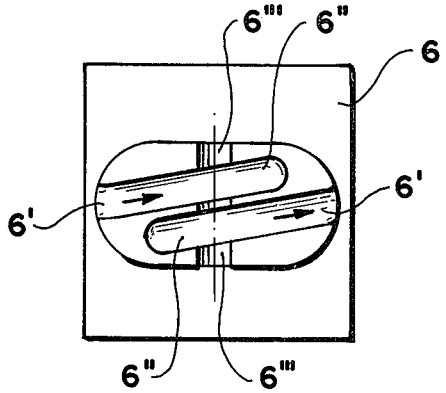

FIG. 1A shows piston 6 in more detail to indicate how piston 6 in conjunction with piston 7 form a temporary helical yarn duct around the twisting pin 4 when in position in the aperture 5. Yarn 11 fed into the guide duct 2' is pulled by suction device 10 through the opening 6' and around the helical grooved 6'' which mates with a connecting helical groove 7'' in piston 7 forming the duct around the twisting pin 4 and connecting with a second parallel groove 6'' which leads to exit groove 6' and thence to yarn guiding duct 3' to form a closed helical yarn path for the yarn 11 around twist pin 4.

Figure 2:
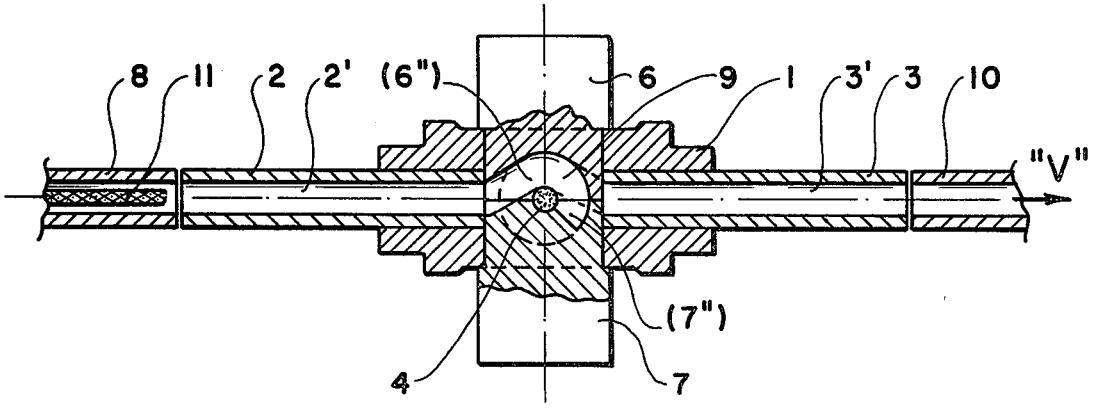
Figure 3:
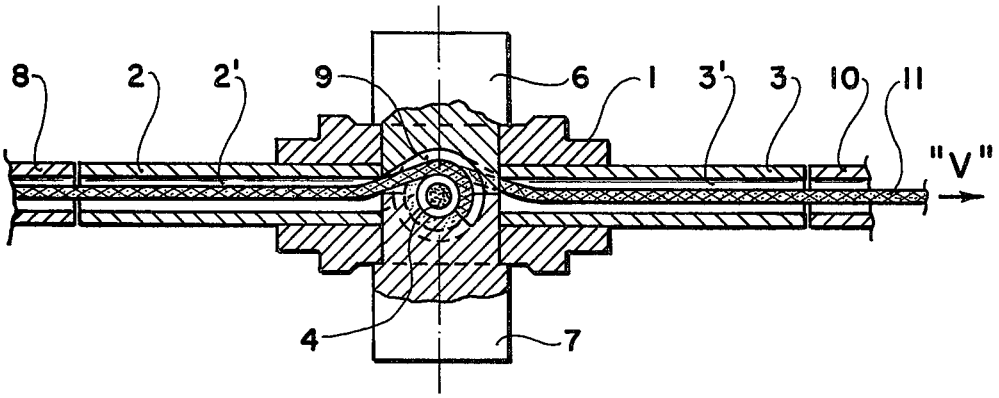

As shown in FIG. 2, yarn 11 travels, for example via yarn feed unit 8, to the feed point 2'' (FIG. 1) of the upstream pipe 2, and a suction device 10 is connected to the delivery end 3'' (FIG. 1) of downstream pipe 3. Due to the vacuum applied at the delivery end which acts via thread guiding duct 3', helical yarn duct 9 and yarn guiding duct 2' formed by yarn duct top part 6'' and yarn duct bottom part 7'', the end of yarn 11 is aspirated through the false-twisting spindle. This situation is illustrated in FIG. 3 wherein "V" indicates the draw-off direction of yarn 11.

Figure 4:
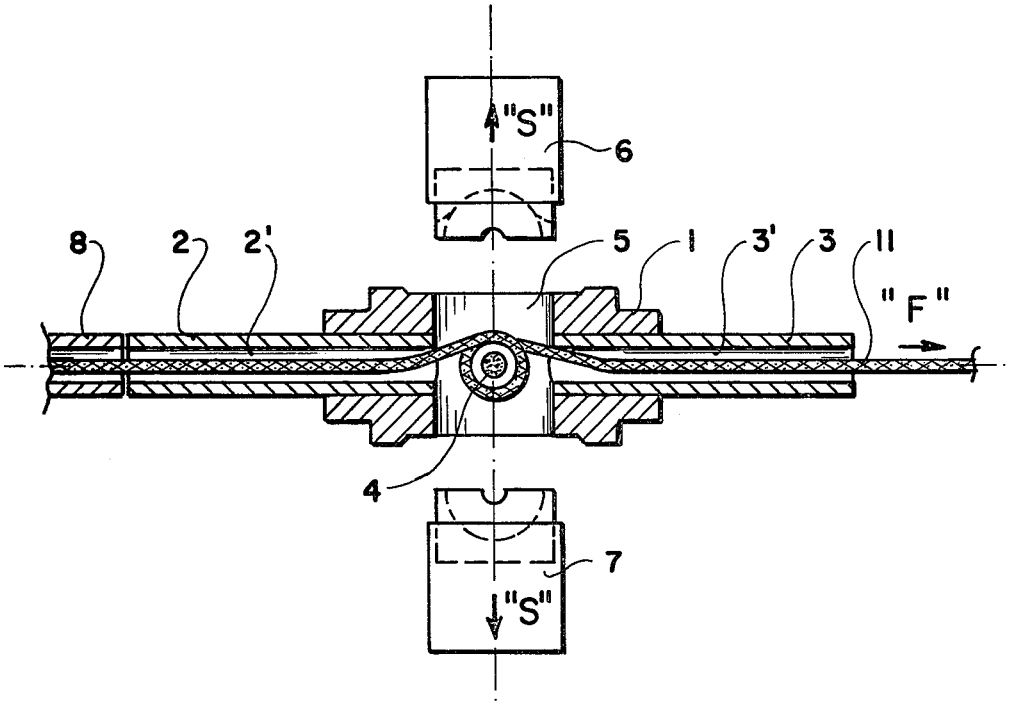
Figure 5:
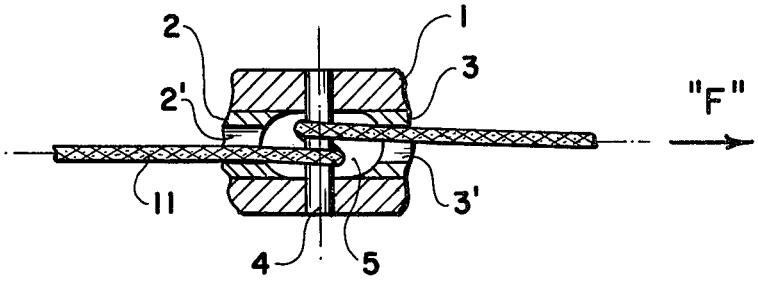

Once yarn 11 has been threaded in the false-twisting spindle and transported in the direction of the arrow "F" for instance to a feed unit, "pistons" 6 and 7 can once more be withdrawn from yarn threading aperture 5, c.f. FIG. 4, arrow "S". As shown in FIG. 5, yarn 11 now winds properly on twisting pin 4. The false-twisting spindle is thus ready for operation.

What is claimed is:

1. The process of threading in a false-twisting spindle having a rotor body and an upstream pipe and downstream pipe, a twisting pin aligned in the rotor body with said upstream pipe and downstream pipe, a cylindrical threading aperture in perpendicular alignment with the pin, the upstream and downstream pipes forming yarn guiding ducts to the twisting pin, comprising the steps of temporarily forming a helical yarn duct in the threading aperture around the twisting pin connecting the yarn guiding ducts of the upstream and downstream pipes, aspirating a yarn to be false-twisted through the upstream yarn guiding duct, the helical yarn duct and downstream yarn guiding duct in sequence, and removing the helical yarn duct.

2. A thread in device for a false-twist spindle having a rotor body and an upstream pipe and downstream pipe, a twisting pin aligned in the rotor body with the upstream and downstream pipe, a cylindrical threading aperture through the rotor and in perpendicular alignment with the threading pin, the upstream and downstream pipes forming yarn guiding ducts to the twisting pin, comprising first and second pistons (6 and 7), each piston having a lug section with its outer surface matching the cylindrical threading aperture, the first piston (6) having a clearance groove (6''') for the twisting pin and parallel grooves (6'') in the end face of the lug section, the second piston having a matching clearance groove (7''') for the twisting pin and a connecting groove (7'') in the end face of the lug section, said first and second pistons forming, when joined together in the threading aperture, a closed helical yarn path around the twisting pin connecting the upstream and downstream yarn guiding ducts.

* * * * *